United States Patent [19]

Langen

[11] Patent Number: 4,514,957

[45] Date of Patent: May 7, 1985

[54] BAG LOADING MACHINE

[75] Inventor: Marinus J. M. Langen, Rexdale, Canada

[73] Assignee: H. J. Langen & Sons Limited, Mississauga, Canada

[21] Appl. No.: 463,584

[22] Filed: Feb. 3, 1983

[51] Int. Cl.[3] ..... B65B 5/06; B65B 43/52

[52] U.S. Cl. ..... 53/252; 53/258; 53/250

[58] Field of Search ..... 53/249, 250, 258, 261, 53/255, 252, 566

[56] References Cited

U.S. PATENT DOCUMENTS

| | | | |
|---|---|---|---|
| 2,402,869 | 6/1946 | Buchanan et al. | 53/261 |
| 2,737,001 | 3/1956 | Bucha | 53/566 |
| 3,036,415 | 5/1962 | Ayres et al. | 53/262 |
| 3,088,257 | 5/1963 | Penley | 53/258 |
| 3,153,309 | 10/1964 | Euwe | 53/250 |
| 3,323,283 | 6/1967 | Johnson, Jr. et al. | 53/566 |
| 3,585,782 | 6/1971 | Staley | 53/249 |

FOREIGN PATENT DOCUMENTS

| | | | |
|---|---|---|---|
| 596704 | 5/1934 | Fed. Rep. of Germany | 53/252 |
| 1319048 | 5/1973 | United Kingdom | 53/258 |

*Primary Examiner*—Daniel C. Crane

*Attorney, Agent, or Firm*—Featherstonhaugh & Co.

[57] ABSTRACT

The bag loading machine of the present invention permits bags which are manufactured in an open condition to be transferred directly from the bag making machine to a bag loader wherein a load is inserted into the bag and thereafter, the loaded bag is discharged. The bag loading machine includes a bag transfer platform which is supported to articulate about a lever as it is raised and lowered so as to move the platform between a bag receiving position for receiving a bag from a bag making machine, a bag loading position for receiving a load and a bag discharge position from which the loaded bag is discharged.

8 Claims, 5 Drawing Figures

BAG LOADING MACHINE

FIELD OF INVENTION

This invention relates to bag loading machines. In particular, this invention relates to a bag loading machine for loading self-sustaining open bags.

PRIOR ART

In my prior U.S. Pat. No. 4,184,413, dated Jan. 22, 1980, there is disclosed a bag making machine capable of making a bag and dispensing a bag in an open configuration. In my prior U.S. Pat. No. 4,274,245, dated June 23, 1981, there is disclosed a check out counter for use in grocery stores and the like which incorporates a bag making machine of the type described in U.S. Pat. No. 4,184,413.

Considerable difficulty has long been experienced in attempting to load goods into paper bags because of the difficulty in maintaining the bag in an open configuration. Conventional bags are creased and folded so as to be located in a knock-down configuration during shipping and storage. My new bag is a self-sustaining open bag when it is dispensed from the bag making machine of U.S. Pat. No. 4,184,413.

I have found that the self-sustaining bag which are previously developed is well suited for end loading of goods when the bag is located in a generally horizontal position, and the present mechanism is designed to permit end loading of such a bag.

It is an object of the present invention to provide a simple and efficient mechanism for transferring an open bag from my prior bag making machine to a load receiving position in which a bag may be loaded and subsequently discharging the loaded bag.

According to one aspect of the present invention, there is provided a bag loading machine comprising a load dispenser means for dispensing a load into a bag loading station, bag embracing means in said bag loading station, receiver means for receiving loaded bags, a bag transfer platform having a front end and a back end, platform mounting means mounting said platform for movement between, a first position in which said front end is disposed at a discharge end of a bag making machine from which a bag is discharged bottom first and on its side, said platform being arranged to underline and support said bag with its open end opening toward said front end of said platform, a second position disposed above said first position in a bag loading plane in which said platform is disposed in a bag retaining relationship with respect to said bag embracing means to cooperate therewith to retain a bag with its open end disposed toward said load dispenser means and in which said front end of said platform is disposed in a load receiving relationship with respect to said load dispenser means, and a third position in which the discharge end of said platform is disposed below the front end and adjacent to the receiver means whereby a loaded bag may be discharged from the platform onto the receiver means, drive means for sequentially driving said platform between the first, second and third positions and back to the first position.

The invention will be more clearly understood after reference to the following detailed specification read in conjunction with the drawings wherein FIG. 1 is a partially sectioned pictorial side view of a major portion of the bag loading machine constructed in accordance with an embodiment of the present invention;

Figure 1:
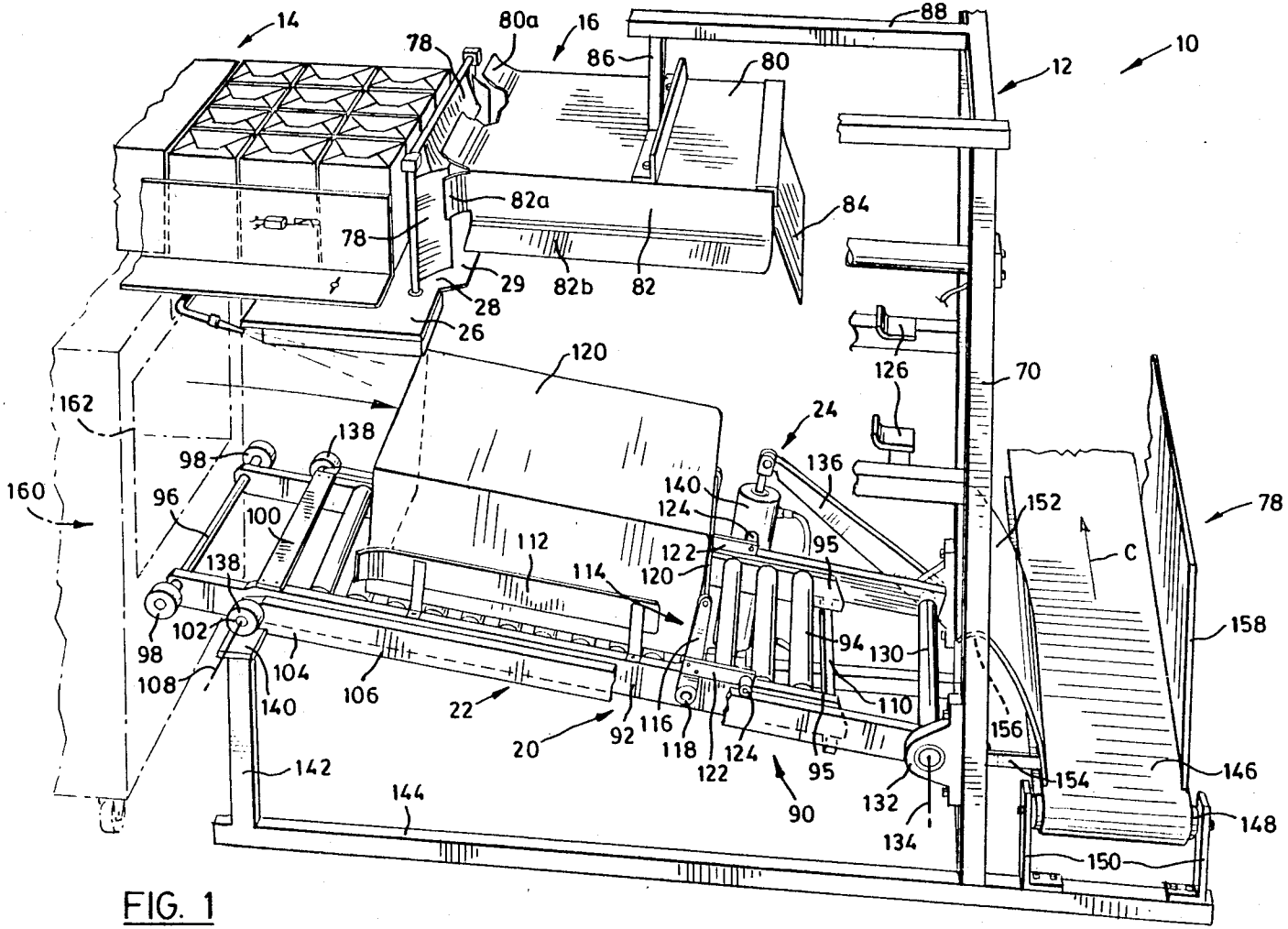

With reference to FIG. 1 of the drawings, the reference numeral 10 refers generally to a bag loading machine constructed in accordance with an embodiment of the present invention. The bag loading machine 10 comprises a frame 12 which supports a load dispenser 14, a bag embracing shroud 16, a bag receiver 18, a bag transfer platform 20, a platform mounting mechanism 22 and a platform drive mechanism 24.

LOAD DISPENSER

Figure 2:
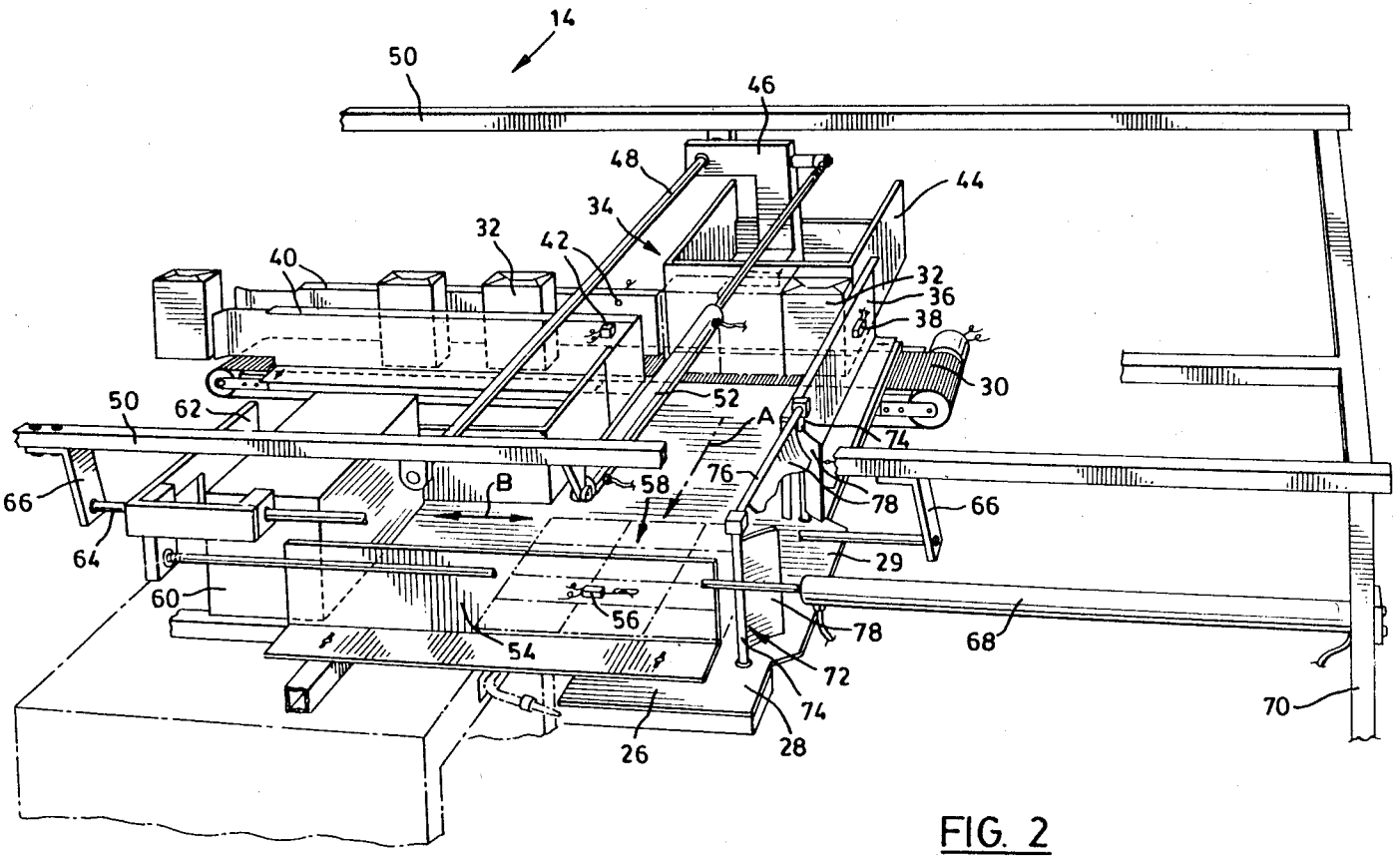
FIG. 2 is a partially sectioned pictorial side view of the load dispensing mechanism of FIG. 1.

The load dispenser is best illustrated in FIG. 2 of the drawings to which reference will now be made. The load dispenser 14 includes a loading platform 26 which has a discharge edge 28. A conveyor 30 is arranged to extend along a side edge of the loading platform 26 to position load units 32 in a load accumulating station 34. The load units 32 are driven against a stop wall 36. A load detector 38 is mounted on the wall 36 and serves to detect the presence of a load unit appearing against the stop wall 36. A pair of adjustable guide walls 40 form a guide path above the conveyor 30 along which load units 32 are driven. A load counter device 42 is provided at the discharge end of the guide walls 40. The counter 42 serves to count the number of load units which have passed into the load accumulating station 34. A first pusher member 44 is mounted on a hanger member 46 which is slidably mounted on a shaft 48 which is supported by frame members 50. An extensible ram 52 has one end secured to one of the frame members 50 and its other end secured to the hanger 46. The ram 52 is extensible to position the pusher 44 in the position shown in FIG. 2 of the drawings and is retractable to cause the pusher 44 to move a partially accumulated load across the platform 26 to bear against the side wall 54. A further load detector member 56 is provided on the side wall 54 and serves to detect the presence of a load. The load is accumulated in a loading station generally identified by the reference numeral 58, an outline of the accumulated load being shown in broken lines in the load accumulating station 58.

A second pusher member 60 is slidably mounted on the loading platform 26 for movement to and fro across the platform in the direction of the arrow B. A bracket 62 is secured to the second pusher member 60 and is slidably mounted on a guide rod 64 which is supported at opposite ends thereof by brackets 66 which depend from the frame member 50. An extensible ram 68 has one end thereof secured to a frame upright 70. The other end of the extensible ram 60 is secured to the bracket 62. When the ram 68 is in the extended position, it locates the second pusher member 60 in the position shown in FIG. 2, and when in the retracted position it positions the pusher at the location required to discharge the accumulated load into an open bag.

A gateway generally identified by the reference numeral 72 is located at the discharge edge of the platform 54. The gateway 72 consists of upright posts 74 and a cross-bar 76. Flexible guide blades 78 are mounted on the posts 74 and cross-bar 76 and are normally inclined away from the load accumulating station 58. As will be described to you hereinafter, as the accumulated load is pushed from the load accumulating station 56 across the discharge edge 28 of the platform 26, it is driven through the gateway 72 and deflects the flexible blades 78 outwardly into the open end of a bag.

In use, a first load unit 32 is driven along the conveyor 30 into engagement with the end wall 36 and successive load units 32 are driven along the conveyor into engagement with one another to form a first assembly. The presence of the first load unit which engages the end wall 36 is determined by the detector 38 and subsequent load units are counted by the counter 42. As soon as the required preliminary load is accumulated, the ram 52 is activated to its retracted position causing the pusher 44 to move the preliminary load across the loading platform 26 in a direction of the arrow A into engagement with the side wall 54 to make contact with the detector 56. The ram 52 is then extended to return the pusher 48 to the position shown in FIG. 2, and the process is repeated until a complete load is assembled in the loading station 58. When the complete load is assembled and a bag is operably located as will be described hereinafter, the ram 68 is activated to move the pusher 60 forward in a direction of the forward arrow B into engagement with the load to drive the load through the gateway 72 into the open end of a bag.

BAG EMBRACING SHROUD

Figure 4:
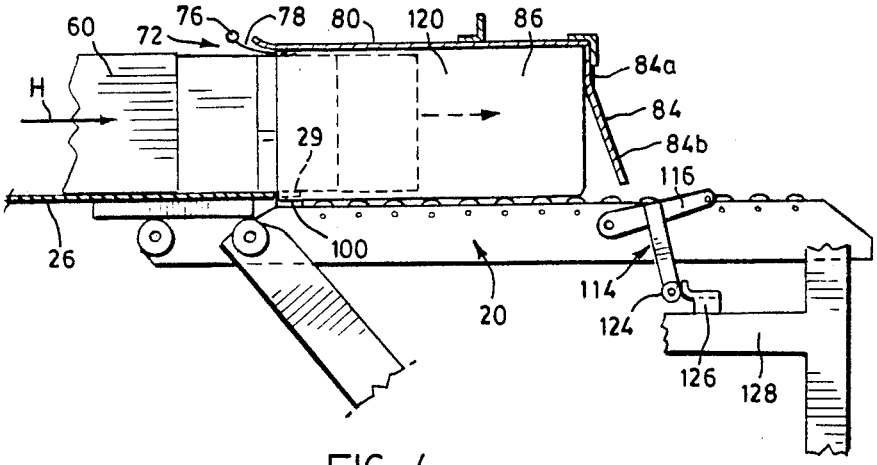
FIG. 3 is a side view of the mechanism of FIG. 1 showing the bag transfer platform in two positions and FIG. 4 is a side view showing the bag transfer mechanism in its second position.
Figure 3:
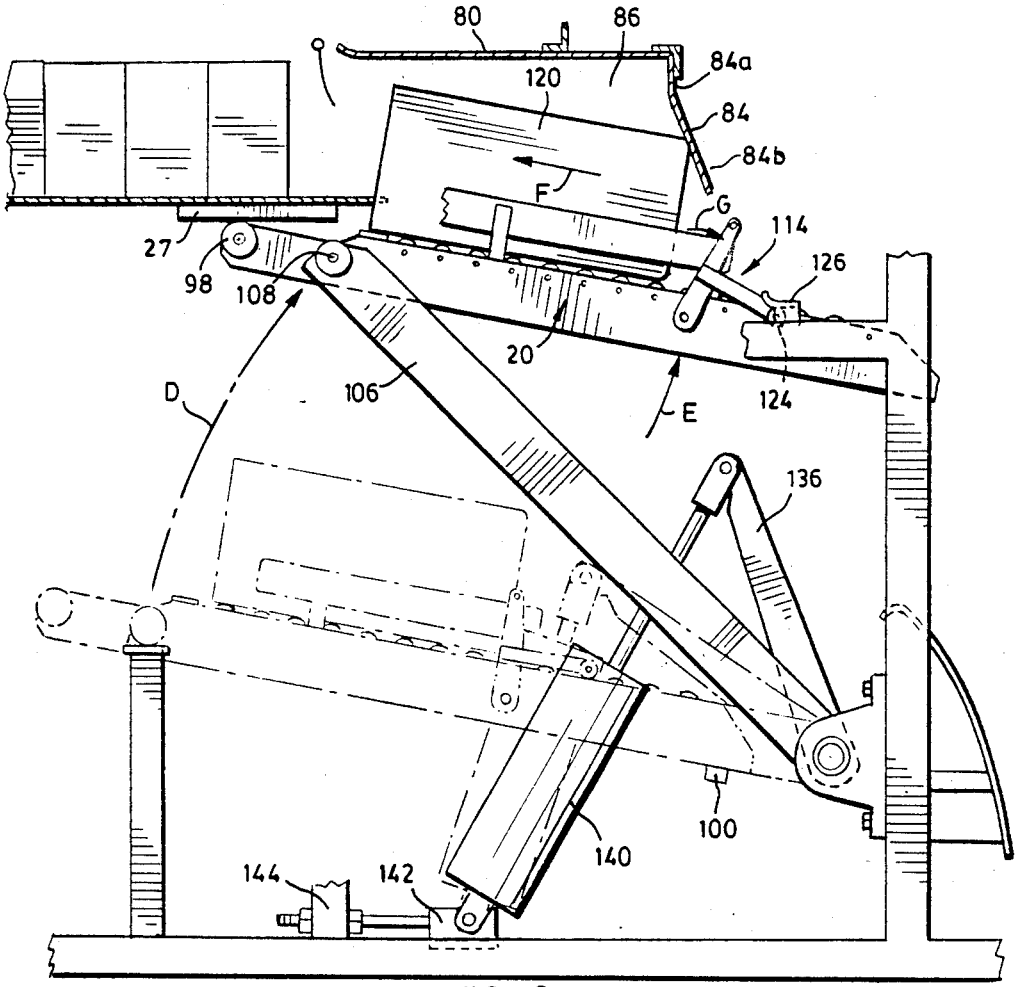

The bag embracing shroud 16 is illustrated in FIGS. 1, 3 and 4 of the drawings. The shroud 16 includes a top wall 80, a pair of oppositely disposed side walls 82 (only one of which is shown) and a back wall 84. The shroud 16 opens downwardly. The shroud 16 is supported from above by an arm 66 which extends downwardly from a frame member 88. The front ends **80*a*, 82*a* of the top wall and side walls 80 and 82 respectively are flared outwardly to facilitate the entry of a load. The lower edge 82*b* of the side walls 82 are also flared outwardly to facilitate the entry of an open bag. The back wall 84 has a short vertically oriented portion 84*a* extending downwardly from the top wall 80 and a long angularly inclined portion 84*b* which extends downwardly and rearwardly from the portion 84*a*. The portion 84*b* forms a camming surface which serves to move an open bag forwardly as it enters the bag loading compartment 86** formed within the shroud.

The flared front edges 80 and **82*a* are arranged to overlie a portion of the discharge edge 28 of the platform 26 such that the flexible blades 78** are deflected outwardly into a face-to-face relationship therewith to clamp to retain the open end of a bag in an open configuration in use.

BAG TRANSFER MECHANISM

The bag transfer platform 20, platform mounting mechanism 22 and platform drive mechanism 24 collectively comprise the bag transfer mechanism which is generally identified by the reference numeral 90.

The bag transfer platform 20 consists of a pair of side rails 92 upon which a plurality of roller members 94 are mounted for rotation. The roller members 94 serve to retain the side rails 92 in a spaced parallel relationship. A rod 96 extends transversely between the front ends of the rails 92 at the front end of the bag transfer platform. Cam rollers 98 are mounted at each end of the shaft 96. A resilient gripper pad 100 extends between the side rails 92 and is arranged as will be described hereinafter to be located in a face-to-face relationship with the lip portion 29 of the dispenser edge 28 of the platform 26. The transfer platform 20 is pivotally mounted on shafts 102 which are mounted on the distal ends 104 of the first lever arms 106 of the platform mounting mechanism 22. The platform 20 is rotatable about the axis 108. The back ends 95 of the rails 92 normally rest on the bridge member 110 which is mounted on the lever arms 106 and extends transversely therebetween. The "first position" of the bag transfer platform to which reference will be made hereinafter is the position shown in FIG. 1 of the drawings in which by reason of the weight distribution of the platform about the axis 106, the back end of the platform 20 rests on the bridge member 110 and the platform 24 is downwardly inclined in a direction from the front end thereof toward the back end.

A pair of guide rails 112 are mounted on the rails 92 and extend upwardly therefrom to be disposed opposite one another to form side supports for a bag 120 in use.

A back stop generally identified by the reference numeral 114 is mounted on the rails 92 for movement between a raised position shown in FIG. 1 of the drawings and a lowered position shown in FIG. 4 of the drawings. The back stop 114 is normally retained in its raised position or in its lowered position by providing a friction fit in the mounting use to mount the back stop onto the rails 92. The back stop 114 consists of a pair of arms 116 pivotally mounted by means of pivot pins 118 on the rails 92 and a bag retaining rod 120 which extends transversely between the distal ends of the arms 116. The second arm 122 projects rearwardly from each arm 116 and a roller 124 is mounted at the outer end of each arm 122 in a position so as to overlie the upper edge of the lever arms 106. The rollers 124 are also engaged by cam members 126 (FIG. 4) which project laterally from the frame members 128 as will be described hereinafter. The back stop 114 is normally retained in the raised position or in the lowered position and is only raised by the engagement of the roller 124 with the upper edge of the lever arms 106 and lowered by engagement of the rollers 124 with the cam members 126.

The platform mounting mechanism 23 consists of a pair of first lever arms 106, the proximal ends of which are mounted on a shaft 130 which is journaled in bearings 132 which are supported by the upright frame member 70 for rotation about the second axis 134. The lever arms 106 have rollers 138 located at their distal ends which rest upon shoulder pads 140 located at the upper end of lags 142 which are supported on the horizontal frame members 144. The second lever arm 136 has one end thereof rigidly secured to one end of the shaft 130. The other end of the second lever arm 136 is connected to one end of an extensible ram assembly 140. The other end of the extensible ram assembly 140 is mounted on a slide member 142 which is adjustably mounted on a frame member 144 so as to be movable relative to the frame member 144 to adjust the position of the second end of the extensible ram 140.

BAG RECEIVER

The bag receiver 18 comprises a discharge conveyor 146, one end of which extends around a guide roller 148 which is mounted on a pair of support brackets 150 which extend upwardly from the frame member 144. The other end of the conveyor 146 extends around a driven roller (not shown) in a conventional manner so that the conveyor 146 may be driven in a direction of the arrow C as required in use. A discharge shute 152 is mounted on the frame members 70 by means of brackets 154 so as to extend downwardly and rearwardly from its uppermost edge 156 which is aligned to receive a bag 120 which is discharged from the platform when the platform is in its third position as will be described hereinafter. A back wall 158 is disposed opposite the shute 152 and serves to prevent overshooting of the discharging bag 120 with respect to the conveyor 146.

A bag making machine of the type described in my prior U.S. Pat. No. 4,184,413 is shown in broken lines in FIG. 1 and is generally identified by the reference numeral 160. The bag making machine 160 is positioned with its discharge end 162 arranged to discharge an open bag 120 bottom first onto the bag transfer platform 26. As a result of the downward incline of the bag transfer platform 16 when it is in its first position illustrated in FIG. 1, the bag will travel along the conveyor until it engages the back stop 114.

METHOD OF OPERATION

In use the load dispenser mechanism serves to accumulate a load on the loading platform 26 as previously described. Simultaneously a bag 120 is manufactured in the bag making machine 160 and discharged onto the bag transfer platform when the transfer platform 20 is in its first position illustrated in FIG. 1 of the drawings. When these operations are complete, the extensible ram 140 is activated to move the first lever arms 106 in the direction of the arrow D shown in FIG. 4 of the drawings. It will be apparent that in moving to the position shown in FIG. 3 of the drawings, the bag transfer platform 20 will initially be retained in a position extending parallel to the first arms 106 with the back end thereof supported by the bridge member 110. This relationship will be retained until the rollers 98 engage the stop plate 27 which is located on the underside of the loading platform 26. Thereafter further movement of the arms 106 in a direction of the arrow D will cause the platform 20 to pivot about the axis 108 which will cause the back end of the platform to rotate in the direction of the arrow E. As the platform 20 approaches the position shown in FIG. 3 of the drawings in response to movement in the direction of the arrow E, the back end of the bag 120 engages the inclined portion 84*a* of the back wall 84 of the shroud and is moved forwardly in a direction of the arrow F in response to continued movement. When the platform 20 is in the position shown in FIG. 3, the roller 124 of the back stop 114 engages the cam 126 and begins to pivot rearwardly in the direction of the arrow G. Continued extension of the ram 140 causes the platform 20 to move to the generally horizontal position shown in FIG. 3 of the drawings. This position is the "second position" of the platform. In this position the bag 120 is operably positioned within the shroud 16 with the front edge of the lower side wall thereof clamped between the pressure pad 100 and the lip 29 of the platform 26. This clamping serves to retain the position of the bag 120 during loading thereof. The ram 68 (FIG. 2) of the load dispenser 14 is activated to move the pusher 60 in a direction of the arrow H which in turn moves the accumulated load through the gateway 72 to cause the flexible blades 78 to enter the open end of the bag 120 in advance of the load. The load is driven into the bag until it is fully positioned within the bag. The pusher 60 is then withdrawn and returned to its original position shown in FIG. 2 of the drawings.

Figure 5:
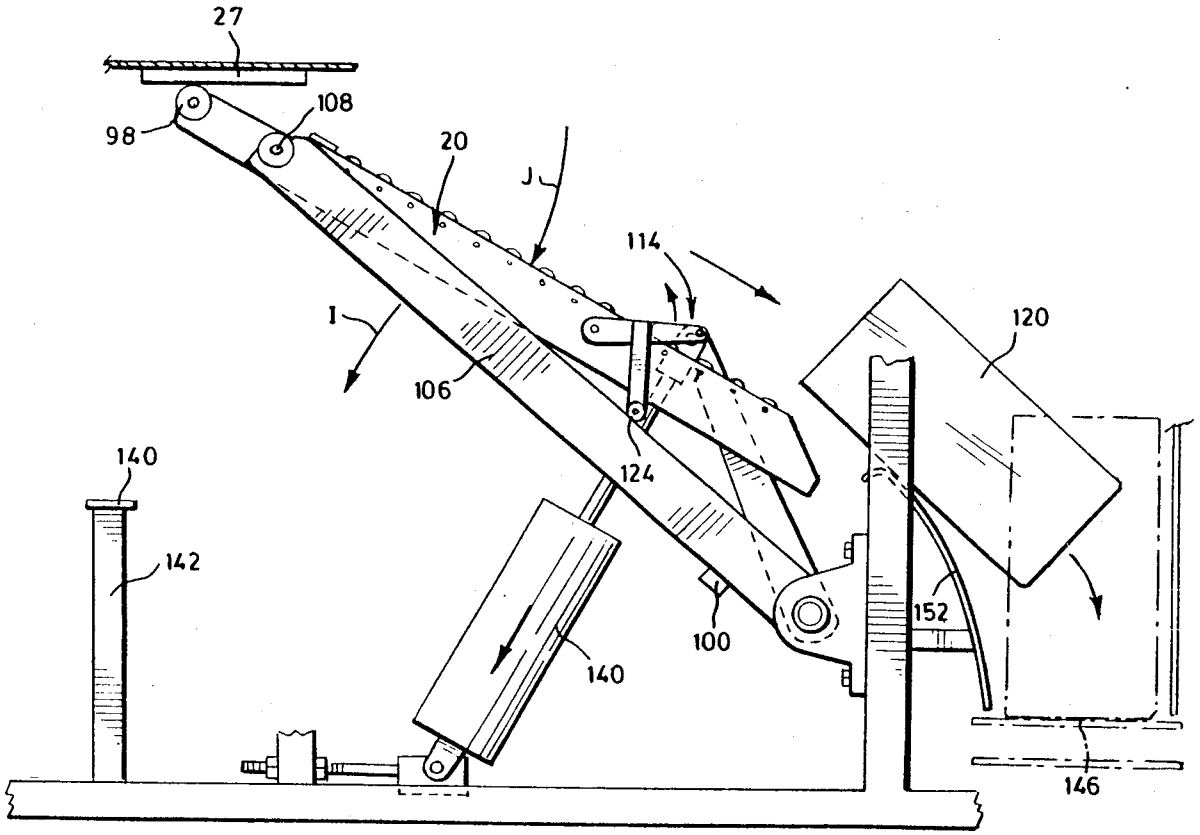
FIG. 5 is a side view of the back transfer mechanism in its third position.

In order to move the platform 20 from the second position shown in FIG. 4 of the drawings to the third position shown in FIG. 5 of the drawings, the ram 140 is retracted, which causes the link arms 106 to rotate in the direction of the arrow I. The weight distribution of the platform 20 causes it to rotate about the axis 108 in the direction of the arrow J while retaining the roller 98 in engagement with the stop plate 27 along which it will run freely. Before the platform 20 reaches the position shown in FIG. 5 of the drawings, the back stop 114 is in the lowered position with respect to the platform 20 shown in FIG. 4 of the drawings, and it will remain in this position for a sufficient period of time to enable the load 120 to be discharged from the platform onto the shute 152 and onto the conveyor 146 as shown in FIG. 5. When the platform arrives at the position shown in FIG. 5, the roller 124 of the back stop engages the upper edge of the link arms 106 and continued movement causes the back stop 114 to be relocated in its raised position. It will be understood that the so called "third position" of the platform 20 is that position immediately before the position illustrated in FIG. 5 wherein the back stop 114 is clear of the upper surface of the platform to permit the loaded bags to be discharged under their own weight from the platform. The loaded bags are then conveyed away from the discharge end of the bag loading machine by the conveyor 146.

The ram 140 continues to contact and when the discharge end of the platform rests on the bridge member 100 the rotation of the platform in the direction of the arrow J is terminated and the platform moves with the link arms 106 in a direction of the arrow I causing the rollers 98 to move away from the stop 27. This movement of the arms 106 continues until the rollers 108 come to rest on the support shoulders 140 in which position the platform 20 is returned to its "first position".

From the foregoing it will be apparent that the present invention provides a simple and efficient mechanical device for use in transferring an open bag from a bag receiving station to a bag loading station and a mechanism for loading the bag and for subsequently discharging the loaded bag to a discharge conveyor.

Various modifications of the present invention will be apparent to those skilled in the art without departing from the scope of the invention. For example, an alternative form of loading mechanism may be provided when individual load units are to be loaded directly into an open bag, in which case a load accumulator is not required.

What I claim as my invention is:

1. A bag loading machine comprising;

(a) a bag receiving station for receiving an open bag from a bag dispenser and a bag loading station for receiving a load from a load dispenser, said bag loading station being located directly above said bag receiving station, (b) bag embracing means mounted and held fast in said bag loading station, said bag embracing means being adapted to embrace the upper, side and outer end walls of a bag and having an open lower end through which a loaded bag may be removed from said bag embracing means, (c) receiver means adjacent said bag receiving station for receiving loaded bags, (d) a bag transfer platform having a front end and a back end, said bag transfer platform underlying the open lower end of said a bag embracing means, said platform being movable relative to said bag embracing means, (e) platform mounting means mounting said platform for movement between;

(I) a first position in which said front end is disposed in the bag receiving station, at a discharge end of said bag dispenser from which a bag is discharged bottom first and on its side, said platform being spaced a substantial distance below the open lower end of the bag embracing means and being arranged to underlie and support said bag on its side with its open end opening toward said front end of said platform;

(II) a second position disposed above said first position in a bag loading plane in which said platform is arranged to close said open lower end of said a bag embracing means and to cooperate therewith to retain a bag in said bag embracing means with its open end disposed toward said load dispenser means and in which said front end of said platform is disposed in a load receiving relationship with respect to said load dispenser means, movement of said platform from said first position to said second position resulting in said spacing being reduced; and (III) a third position in which the discharge end of said platform is disposed below the front end and adjacent to the receiver means whereby a loaded bag may be discharged from the platform onto the receiver means, (f) drive means for sequentially driving said platform between the first, second and third positions and back to the first position.

2. A bag loading machine as claimed in claim 1 wherein said platform mounting means comprises, (a) a frame, (b) first lever means having a proximal end and a distal end, said proximal end being pivotally mounted on said frame adjacent said receiver means for rotation about first axis in a first direction as said platform moves from said first position to said second position and in a second direction opposite said first direction thereafter, and a distal end pivotally supporting said platform rearwardly from said front end thereof for rotation of said platform relative to said lever means about a second axis in a first direction and in a second direction opposite said first direction, (c) first support means on said frame and first stop means on said first lever means for supporting said platform in said first position, said first support means limiting rotation of said first lever means about said first axis in said second direction and said first stop means limiting rotation of said platform about said second axis in said first direction, (d) second stop means disposed above said first support means so as to arrest the movement of said front end of said platform after it has been raised to said bag loading plane while permitting continued rotation of said platform about said first end thereof in response to continued movement of said first lever arm until said platform is disposed in said second position with respect to said load dispenser means, rotation of said first lever means in said second direction initially causing said platform to pivot about said front end engagement with said second stop means until said platform is disposed in said third position and further rotation of said first lever means in said second direction returning said platform to said first position.

3. A bag loading mechanism as claimed in claim 1 further comprising, (a) back stop means mounted on said bag transfer platform for movement between a raised position and a lowered position, said raised position being one in which it projects above said bag transfer position to form a back stop limiting the extent to which a bag may be moved along said bag transfer platform from said first end and said lowered position being one in which a bag is free to discharge from said transfer platform by way of said discharge end, (b) back stop actuator means for effecting movement of said backstop between said raised position and said lowered position as required in use.

4. A bag loading mechanism as claimed in claim 1 wherein said bag embracing means comprises a guide shroud having an upper wall, a pair of oppositely disposed side walls and an end wall arranged to embrace the upper, side and back walls of a bag positioned on said platform when said platform is in said second position thereby to prevent outward deformation of the upper side and back walls of the bag during loading.

5. A bag loading machine as claimed in claim 1 wherein drive means comprises an extensible ram having one end secured to the frame and a second end drivingly connected to said first link arms whereby extension of said extensible ram effects movement of said link arms in said first direction and contraction of said extensible ram effects movement of said link arms in said second direction about said first axis.

6. A bag transfer platform as claimed in claim 2 wherein said first stop means is mounted on said first lever means and arranged to retain said bag transfer platform in a longitudinal alignment with said first lever means when in said first position.

7. A bag loading machine as claimed in claim 1 wherein said load dispenser means includes a loading platform having a discharge end over which the load is discharged into a bag, said discharge end being arranged to project into an open end of a bag to overlie an edge of the open end of a bag supported on said platform, said bag transfer platform being spaced from said discharge end of said loading platform when said platform is in said first position and is arranged to bear against the underside of said discharge end of said loading platform to clamp an edge of the open end of a bag therebetween when said platform is in said second position.

8. A bag loading machine as claimed in claim 7 wherein said load dispenser means further comprises a gateway mounted at the discharge edge of said loading platform, said gateway comprising a pair of jams and a header member, a side gate member mounted on each jam and a top gate member mounted on said header, said side and top gate members normally extending across said gateway and being located in a position overlying said discharge end of said loading platform said load dispenser means dispensing a load through said gateway to engage said gate members to deflect said side and top gate members outwardly to a position in which they extend into an open end of a bag in use to facilitate the transfer of a load into an open bag in use.

* * * * *